US005996500A

United States Patent [19]

Findley

[11] Patent Number: 5,996,500

[45] **Date of Patent: *Dec. 7, 1999**

[54] ELECTROSTATICALLY DISCHARGEABLE PRIMER

[76] Inventor: Stephan D. Findley, 710 Willow St., Marshall, Tex. 75670

[ * ] Notice: This patent issued on a continued prosecution application filed under 37 CFR 1.53(d), and is subject to the twenty year patent term provisions of 35 U.S.C. 154(a)(2).

[21] Appl. No.: 08/688,085

[22] Filed: Jul. 29, 1996

Related U.S. Application Data

[60] Provisional application No. 60/008,413, Dec. 8, 1995.

[51] Int. Cl.[6] ..... F42B 3/14

[52] U.S. Cl. ..... 102/202.8; 102/202.5; 102/202.9; 102/472

[58] Field of Search ..... 102/472, 202.8, 102/202.9, 202.14, 202, 202.2, 355, 202.5, 470; 89/28.05

[56]

References Cited

U.S. PATENT DOCUMENTS

| | | | |
|---|---|---|---|
| 2,918,871 | 12/1959 | Taylor | 102/202.8 |
| 3,726,217 | 4/1973 | Dedman et al. | 102/202.8 |
| 3,754,506 | 8/1973 | Parker | 102/202.8 |
| 4,070,970 | 1/1978 | Scamaton | 102/202.8 |
| 5,044,278 | 9/1991 | Campbell | 102/202.8 |
| 5,235,127 | 8/1993 | Findley | 102/200 |
| 5,353,710 | 10/1994 | Eches et al. | 102/443 |
| 5,361,702 | 11/1994 | Goetz | 102/472 |
| 5,515,783 | 5/1996 | Hesse et al. | 102/206 |
| 5,625,972 | 5/1997 | King et al. | 42/84 |
| 5,739,459 | 4/1998 | La Mura et al. | 102/217 |
| 5,767,439 | 6/1998 | Lindblom et al. | 102/472 |

FOREIGN PATENT DOCUMENTS

| | | | |
|---|---|---|---|
| 816530 | 7/1959 | United Kingdom | 102/202.8 |

OTHER PUBLICATIONS

Definition for "membrane," Webster's New Riverside University Dictionary, 1994.

*Primary Examiner*—Harold J. Tudor

*Attorney, Agent, or Firm*—Akin, Gump, Strauss, Hauer & Feld

[57] ABSTRACT

An electrostatically dischargeable primer which in a preferred embodiment is characterized by an electrically non-conductive plastic case having a base end, an open end and a powder cavity filled with powder, an electrically conductive metallized plastic, or carbon-filled, or metal electrode extending through the base and the plastic case and communicating with the powder cavity and an electrically conductive membrane seal closing the open end of the non-conductive plastic case and sealing the powder cavity. In a first preferred embodiment a concave tower receptacle is defined in the base of the non-conductive plastic case opposite the conductive membrane seal to interface with the electrode tower and positive electrode of an ignition coil. In a second preferred embodiment the tower receptacle is eliminated in favor of a flat base, through which the electrode projects. The electrostatically dischargeable (electric) primer may be mounted in any desired cartridge and the cartridge or cartridges seated in a firing plate to facilitate both single and multiple burst sequences by operation of the corresponding ignition coil or coils. Electrical interrogation and firing pulses may be applied to the electric primer by the ignition coil to ascertain the nature, location and type of electric primer and cartridge under consideration and to fire the electric primer, respectively.

20 Claims, 1 Drawing Sheet

ELECTROSTATICALLY DISCHARGEABLE PRIMER

BACKGROUND OF THE INVENTION

Cross-Reference to Related Patent Applications

This application is U.S. Provisional Patent Application Serial No. 60/008,413, filed Dec. 8, 1995.

Field of the Invention

This invention relates to pyrotechnic devices, systems and firing circuits and more particularly, to an electrostatically dischargeable (electric) primer which may be used in substantially any cartridge. In a first preferred embodiment the electric primer is characterized by an electrically non-conductive plastic case fitted with a metal or metallized plastic or carbon-filled, electrically conductive center electrode which extends into a cavity packed with pyrotechnic powder. An electrically conductive membrane seal seals the pyrotechnic powder cavity and in a first preferred embodiment a concave tower receptacle is provided in the base of the electric primer to receive and match the curved end of an electrode tower extending from an ignition coil and having a positive electrode for engaging the center electrode in the electric primer and selectively investigating the primer and carrier cartridge with an interrogation pulse and discharging the pyrotechnic powder in the primer cavity. In a second preferred embodiment, the base of the non-conductive plastic case is substantially flat and continuous, with the electrode extending therethrough at the center thereof for receiving the positive electrode of the ignition coil. Voltage applied to the center electrode of the electric primer by the ignition coil effects a spark between the center electrode and the conductive membrane seal, thus firing the pyrotechnic powder in the electric primer and, in turn, firing the cartridge in which the electric primer is inserted.

A primary advantage of the electric primer of this invention is the facility for receiving an interrogation pulse from the connecting ignition coil through the center electrode of the electric primer to determine the nature, location and/or type of electric primer and carrying cartridge under investigation, especially under circumstances where the electric primer is to be fired by a computer which orchestrates alteration of the ignition coil. Accordingly, multiple electric primers may be mounted in a non-conductive firing plate and fired in a selected sequence, either manually or by computer operation, using the ignition coils to effect ignition of the pyrotechnic primer powder, either in the absence of or after an interrogation pulse applied to all or selected ones of the electric primers for identification and/or location purposes.

Description of the Prior Art

One of the problems associated with conventional pyrotechnic devices and systems and corresponding firing circuits, including percussion primers, electric squibs and like devices of various design, is that of the susceptibility of these devices to premature and undesirable firing by electromagnetic and other radiation, as well as limited shelf life, high expense, environmental disposal problems and the like. For example, conventional percussion-type primers are particularly prone to accidental discharge and have limited shelf life, thus limiting the utility of these devices. Furthermore, the popular electric bridgework apparatus is susceptible to accidental discharge by stray electromagnetic and other radiation and may be expensive to use, depending upon the application desired.

My U.S. Pat. No. 5,235,127, dated Aug. 10, 1993, details a "Weapon Discharge Simulation System and Electrostatically Discharged Pyrotechnic Cartridge For Use in Said System". The device is designed to simulate the firing of weapons by igniting various signature cartridges, both singularly and in multiple burst sequences. An electronic timing source provides the necessary control and impulse to effect the ignition and a unique cartridge design provides safe and reliable performance in the system.

Accordingly, it is an object of this invention to provide a new and improved electrostatically dischargeable primer which is characterized by an electrically non-conductive, preferably plastic case, a metal or metallized plastic or carbon-filled, electrically conductive center electrode extending through the non-conductive case and base, a pyrotechnic powder cavity shaped in the plastic case for receiving a charge of powder and an electrically conductive membrane seal closing the powder cavity at the opposite end of the plastic case from the base. The base is optionally fitted with a concave tower receptacle for receiving the projecting end of an electrode tower of an ignition coil for selectively firing the primer.

Another object of this invention is to provide a new and improved electrostatically dischargeable primer which includes a shaped, electrically non-conductive plastic case having a flat base, an internal powder charge and fitted with an electrically conductive center electrode extending through the base and case into the powder charge. The case is closed at the end opposite the base by an electrically conductive membrane seal and the primer is fired by a conventional ignition coil that may also be computer-operated to emit an interrogation pulse into the primer for identification and/or location purposes prior to firing of the primer.

Still another object of this invention is to provide a new and improved electrostatically dischargeable primer having a selectively-shaped, non-conductive case with a pyrotechnic powder cavity formed therein for receiving a powder charge and closed at one end by an electrically conductive membrane seal, the opposite end of the case having a flat base that accommodates an elongated conductor or center electrode extending into the powder, with a concave tower receptacle therein. The tower receptacle communicates with the conductive electrode and is shaped to receive the electrode tower and positive electrodes of an ignition coil for selective investigative and/or location pulsing and firing of the electric primer.

Another object of this invention is to provide a new and improved electrostatically dischargeable primer having a selectively-shaped, non-conductive plastic case with a pyrotechnic powder cavity formed therein for receiving a powder charge and closed at one end by an electrically conductive membrane seal, the opposite end of the case having a flat base that accommodates an elongated conductor or center electrode extending into the powder, which conductor electrode is oriented to contact the electrode tower and positive electrode of an ignition coil for selective investigative pulsing and/or location and firing of the primer.

SUMMARY OF THE INVENTION

These and other objects of the invention are provided in a new and improved electrostatically dischargeable primer for mounting in a cartridge of choice, which electric primer includes a selectively-shaped, electrically non-conductive plastic case, an elongated metal or metallized plastic or carbon-filled center electrode extending through the plastic case from the face or base of the case, which base may be optionally provided with a concave tower receptacle for receiving the electrode tower and positive electrode of an ignition coil. The opposite end of the plastic case is closed by a metallized plastic, carbon-filled or metal conductive membrane seal spaced from the center electrode to facilitate generation of a spark in a powder cavity provided with a powder charge between the center electrode and the conductive membrane seal upon activation of the ignition coil. The electric primer may be mounted in the cartridge in conventional manner and may optionally include the capability of receiving an interrogation pulse from the ignition coil to the electric primer for identification and/or location purposes prior to firing of the electric primer and cartridge of predetermined capability, to simulate the firing of various weapons systems.

BRIEF DESCRIPTION OF THE DRAWING

The invention will be better understood by reference to the accompanying drawing, wherein.

DESCRIPTION OF THE PREFERRED EMBODIMENTS

Figure 1:
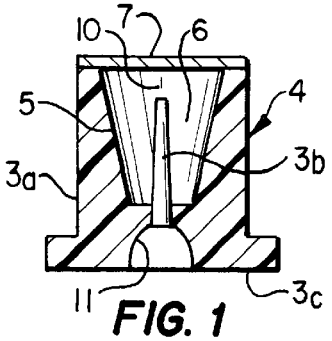
FIG. 1 is a side sectional view of a first preferred embodiment of the electrostatically dischargeable primer of this invention.
Figure 2:
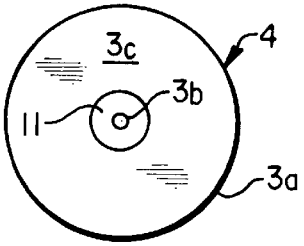
FIG. 2 is a base end view of the electric primer illustrated in FIG. 1.
Figure 5:
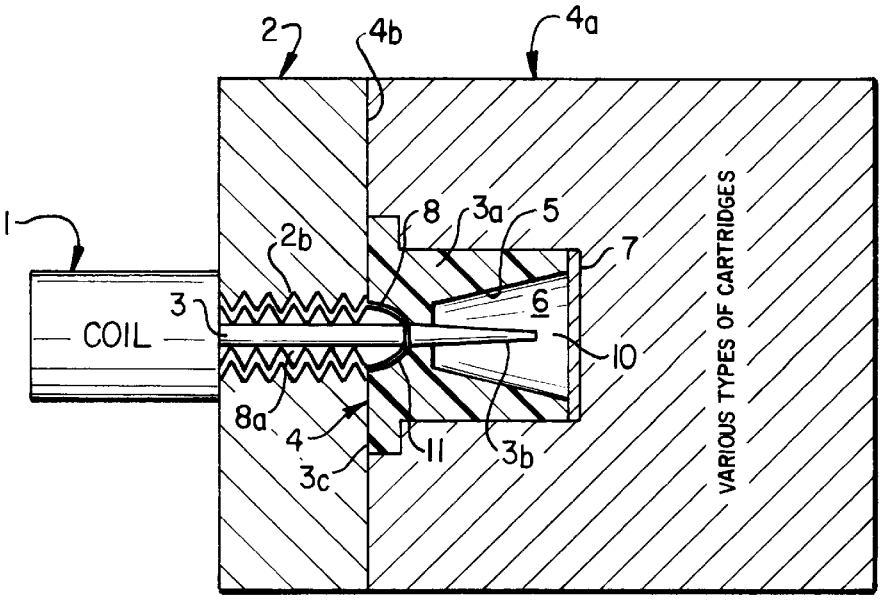
FIG. 5 is a side sectional view of the electrostatically dischargeable primer illustrated in FIG. 1 mounted in a cartridge, seated against a firing plate and fitted with an ignition coil for interrogating and firing the electric primer and the cartridge.

Referring initially to FIGS. 1 and 2 of the drawing, in a preferred embodiment the electrostatically dischargeable primer (electric primer) of this invention is identified by reference numeral 4. In a first preferred embodiment the electric primer 4 includes an electrically non-conductive electrode case 3*a*, which receives a metal or metallized plastic or carbon-filled, electrically conductive center electrode 3*b* that extends to a concave tower receptacle 11, formed in the base 3*c*. The tower receptacle 11 is designed to receive the curved end of the electrode tower 8 of an ignition coil 1 when the electric primer 4 is mounted in functional configuration on a non-conductive plastic firing plate 2, as illustrated in FIG. 5. The electrode tower 8 is fitted with a positive electrode 3 which seats against the center electrode 3*b* provided in the electric primer 4 and the opposite end of the center electrode 3*b* projects into a pyrotechnic or powder composition 6, packed into a powder cavity 5 shaped in the electrode case 3*a*. The powder 6 and powder cavity 5 are sealed at the end opposite the base 3*c* by means of an electrically conductive membrane seal 7, which is welded, glued or otherwise attached to the electrode case 3*a* and is spaced from the center electrode 3*b* by a spark gap 10, as illustrated in FIGS. 1 and 3.

Figure 3:
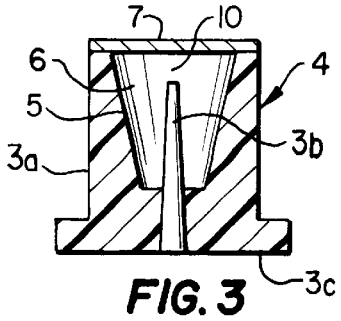
FIG. 3 is a side sectional view of an alternative preferred embodiment of the electrostatically dischargeable primer.
Figure 4:
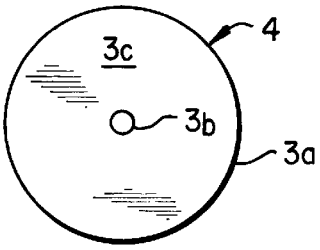
FIG. 4 is a base end view of the electric primer illustrated in FIG. 3.

As illustrated in FIGS. 3 and 4 of the drawing, in a second preferred embodiment of the invention the electric primer 4 is designed similar to the electric primer 4 illustrated in FIGS. 1 and 2, except that the base 3*c* is flat, with the center electrode 3*b* protruding into a flush fit therein, wherein the tower receptacle 11 is eliminated.

Figure 6:
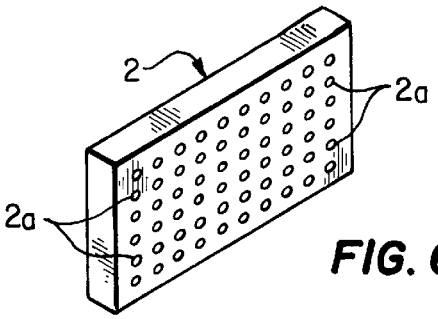
FIG. 6 is a perspective view of a typical non-conductive firing plate fitted with multiple openings for receiving multiple ignition coils and mounting corresponding electric primers and cartridges in order to simulate the firing of multiple cartridges in a selected sequence.

Referring now to FIGS. 5 and 6 of the drawing, the electric primer 4 is pressed in conventional fashion into the primer-receiving end 4*b* of a cartridge 4*a*. The electric primer 4 is oriented such that the base 3*c* is fitted against the flat receiving face of the non-conductive plastic plate 2 at a threaded plate opening 2*a*, illustrated in FIG. 6, for receiving the threaded electrode tower 8, the curved end of which electrode tower 8 projects into the concave tower receptacle 11 in the base 3*c* of the electric primer 4, to contact the positive electrode 3 with the exposed end of the center electrode 3*b*. The electric primer 4 is thus seated in the cartridge 4*a* in conventional manner and the ignition coil 1 is thus positioned to effect firing of the electric primer 4 at a desired time. An interrogation pulse may be emitted by the ignition coil 1 to the electric primer 4 to identify the particular type of electric primer 4 and cartridge 4*a* and/or locate these elements prior to firing of the electric primer 4 and the cartridges 4*a*, for purposes which will be hereinafter described.

Referring again to FIGS. 5 and 6 of the drawings it will be appreciated that under ordinary circumstances, multiple units of the electric primer 4 and the cartridge 4*a* are installed on a common non-conductive plastic plate 2 of desired size and having desired number of plate openings 2*a* to simulate a weapons system of desired capability. For example, under circumstances where it is desired to simulate the firing of weapons of different types for different purposes, the system may be computer-operated in the manner detailed in my U.S. Pat. No. 5,235,127 and the computer (not illustrated) electrically connected to each of the ignition coils 1 to either fire the respective electric primers 4 and cartridges 4*a* or investigate the particular type and/or location of electric primer 4 and cartridge 4*a* which is to be fired in a selected predetermined sequence by the computer. For example, the electric primers 4 and cartridges 4*a* which are designed to simulate the firing of a first type of shell or projectile may be identified by initially causing the corresponding ignition coils 1 to emit an interrogation pulse and identify the location and/or type of the specific electric primers 4 and cartridges 4*a* associated with these projectiles or shells. The projectiles or shells may then be fired by energizing the identified electric primers 4 and cartridges 4*a* by operation of the ignition coils 1, either manually or by computer control. Accordingly, the facility for interrogating the respective electric primers 4 and cartridges 4*a* prior to firing provides an inexpensive, efficient and highly effective technique for using projectiles or shells of selected design for specific purposes in a common firing plate 2 or the equivalent, in battle.

It will be appreciated by those skilled in the art that the electrode case 3*a* of the electric primer 4 of this invention can be constructed of substantially any electrically non-conducting material such as plastic, including polyethylene, polypropylene, ABS and the like, in non-exclusive particular, according to the knowledge of those skilled in the art. Other electrically non-conducting materials such as fiberglass and the like may also be used. The electrode case 3*a* can be injection molded by suitable molding techniques also well known to those skilled in the art. Furthermore, the conducting center electrode 3*b* can be constructed of substantially any metallized or doped or carbon-filled plastic or metal, further according to the knowledge of those skilled in the art to facilitate application of a voltage from the ignition coil 1 to effect a spark across the spark gap 10. Similarly, the conductive membrane seal 7 may be constructed of similar metallized or doped or carbon-filled plastic or metal material to further facilitate the spark across the spark gap 10 between the projecting end of the center electrode 3*b* and the corresponding conductive membrane seal 7, to ignite the powder 6 inside the electrode case 3*a*. This ignition further ignites the powder (not illustrated) in the cartridge 4*a* to effect simulated firing of the desired weapons system. The metallized or carbon-filled plastic components may include various types of plastic such as those innumerated above, impregnated, doped or filled with various conductive metals such as steel, aluminum, copper, carbon and the like, in non-exclusive particular, as well as metal tape applied to the plastic and further including metallized acetate, carbon and other conducting materials for the construction of the center electrode 3*b* and the conductive membrane seal 7 in order to effect the desired spark between these two elements. Alternatively, the center electrode 3*b* and the conductive membrane seal 7 or either of them may be constructed of a conductive metal such as copper, silver, aluminum or the like, for the desired purpose.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. An electrostatically dischargeable primer comprising:

(a) a substantially electrically non-conductive case having a base end, an open end opposite said base end and a powder cavity between said base end and said open end;

(b) a first electrode extending through said base end of said case into said powder cavity; and (c) an electrically conductive thin, flexible disc-shaped membrane seal closing said open end of said case and forming a second electrode, whereby powder in said powder cavity is selectively ignited responsive to application of a firing pulse to said electrodes.

2. The electrostatically dischargeable primer of claim 1 comprising a concave tower receptacle provided in said base end for accommodating said firing pulse.

3. The electrostatically dischargeable primer of claim 1 wherein said base end is substantially flat and said firing pulse is applied to said first electrode at said base end.

4. An electrostatically dischargeable primer for mounting in a cartridge and firing the cartridge, said primer comprising:

(a) a substantially electrically non-conductive case having a base end, an open end opposite said base end and a powder cavity located between said base end and said open end, said case adapted for seating in said cartridge;

(b) a first electrode extending through said base end of said case into said powder cavity; and (c) an electrically conductive thin, flexible disc-shaped membrane seal closing said open end of said case forming a second electrode and substantially sealing said powder cavity, wherein said first electrode terminates in said powder cavity in spaced relationship with respect to said membrane seal;

whereby powder in said powder cavity is selectively ignited responsive to application of a firing pulse to said electrodes.

5. The electrostatically dischargeable primer of claim 4 comprising a concave tower receptacle provided in said base end for accommodating said firing pulse.

6. The electrostatically dischargeable primer of claim 4 wherein said base end is substantially flat and said firing pulse is applied to said first electrode at said base end.

7. The electrostatically dischargeable primer of claim 4 wherein said electrically conductive membrane seal comprises a material selected from the group of metallized plastic, doped plastic, carbon-filled plastic and metal.

8. The electrostatically dischargeable primer of claim 7 comprising a concave tower receptacle provided in said base end for accommodating said firing pulse.

9. The electrostatically dischargeable primer of claim 7 wherein said base end is substantially flat and said firing pulse is applied to said first electrode at said base end.

10. An electrostatically dischargeable primer for mounting in a cartridge and firing the cartridge to simulate firing of a weapons system by application of a firing pulse from an ignition coil having an electrode tower, said primer comprising:

(a) a cylindrical, substantially non-conductive case having a base end, an open end opposite said base end and a powder cavity located between said base end and said open end, said case adapted for seating in said cartridge;

(b) a first electrode extending through said base end of said case into said powder cavity; and (c) an electrically conductive thin, flexible disc-shaped membrane seal closing said open end of said case forming a second electrode and substantially sealing said powder cavity, wherein said first electrode terminates in said powder cavity in spaced relationship with respect to said membrane seal;

whereby powder in said powder cavity is ignited responsive to engagement of said electrode tower of said ignition coil with said first electrode and energizing of said first electrode tower by said ignition coil.

11. The electrostatically dischargeable primer of claim 10 comprising a concave tower receptacle provided in said base end for accommodating said electrode tower.

12. The electrostatically dischargeable primer of claim 10 wherein said base end is substantially flat and said electrode tower is applied to said first electrode at said base end.

13. The electrostatically dischargeable primer of claim 10 wherein said electrically conductive membrane seal comprises a material selected from the group of metallized plastic, doped plastic, carbon-filled plastic and metal.

14. The electrostatically dischargeable primer of claim 13 comprising a concave tower receptacle provided in said base end for accommodating said electrode tower.

15. The electrostatically dischargeable primer of claim 13 wherein said base end is substantially flat and said electrode tower is applied to said first electrode at said base end.

16. An electrostatically dischargeable primer comprising:

(a) a substantially electrically non-conductive case having a base end, an open end opposite said base end and a substantially frustoconical shaped powder cavity formed between said base end and said open end;

(b) a first electrode extending through said base end of said case into and substantially centered in said powder cavity; and (c) an electrically conductive thin, flexible disc-shaped membrane seal closing said powder cavity at said open end of said case and forming a second electrode in contact with powder in said powder cavity whereby said powder in said powder cavity is ignited responsive to application of a firing pulse to said electrodes.

17. The electrostatically dischargeable primer set forth in claim 16 wherein:

said membrane seal is attached to said case by one of welding and gluing said membrane seal to said case and in spaced relationship from said first electrode.

18. The electrostatically dischargeable primer set forth in claim 16 wherein:

said case is constructed of a substantially nonconducting material selected from a group consisting of polyethylene, polypropylene and ABS plastic.

19. The electrostatically dischargeable primer set forth in claim 16 wherein:

said first electrode is constructed of one of a metalized or doped or carbon-filled plastic or metal.

20. The electrostatically dischargeable primer set forth in claim 16 wherein:

said membrane seal is constructed of one of a metallized or doped or carbon-filled plastic or metal selected from a group consisting of steel, aluminum, copper and carbon.

* * * * *